US008690740B2

(12) United States Patent
Yu

(10) Patent No.: US 8,690,740 B2
(45) Date of Patent: Apr. 8, 2014

(54) ADJUSTABLE WEIGHT TRAINING DEVICE

(76) Inventor: Yu-Chen Yu, Hsinchu (TW)

( * ) Notice: Subject to any disclaimer, the term of this patent is extended or adjusted under 35 U.S.C. 154(b) by 512 days.

(21) Appl. No.: 13/104,204

(22) Filed: May 10, 2011

(65) Prior Publication Data

US 2012/0289386 A1 Nov. 15, 2012

(51) Int. Cl.
*A63B 21/00* (2006.01)

(52) U.S. Cl.
USPC ..... 482/93; 482/106; 482/108

(58) Field of Classification Search
USPC ..... 482/107, 108, 103
See application file for complete search history.

(56) References Cited

U.S. PATENT DOCUMENTS

| | | | | |
|---|---|---|---|---|
| 7,452,312 | B2 * | 11/2008 | Liu | 482/108 |
| 7,621,855 | B1 * | 11/2009 | Krull | 482/107 |
| 2010/0190618 | A1 * | 7/2010 | Chen | 482/108 |
| 2010/0190619 | A1 * | 7/2010 | Chen | 482/108 |
| 2012/0021877 | A1 * | 1/2012 | Lundquist et al. | 482/107 |
| 2012/0309597 | A1 * | 12/2012 | Liu | 482/107 |

* cited by examiner

*Primary Examiner* — Jerome w Donnelly
(74) *Attorney, Agent, or Firm* — Chun-Ming Shih

(57) ABSTRACT

An adjustable weight training device includes a handle having at two sides. Each side of the handle is provided with a selector unit, an adjustment unit and a plurality of weight discs. The adjustment unit is operated to change the connection of the selector unit and the plurality of weight discs so as to change the weight of the weight training device as desired.

10 Claims, 8 Drawing Sheets

ADJUSTABLE WEIGHT TRAINING DEVICE

BACKGROUND OF THE INVENTION

1. Field of the Invention

The present invention relates to a weight training device, and more particularly to a weight training device which is adjustable in weight for different users.

2. Description of the Prior Art

Dumbbell is one of the popular weight training devices. A conventional dumbbell has a single configuration and a fixed weight. When in use, the user has to choose a suitable dumbbell according to his/her physical ability. If the selected dumbbell is too light, the user needs to buy a heavier one. For the user, the light dumbbell may be useless in the future, which causes a waste. Besides, the conventional fixed weight dumbbell cannot be used by different users because the desired weight of the dumbbell is different. Furthermore, for the makers and sellers, various dumbbells in different weights occupy a lot of space and increase cost. Accordingly, the inventor of the present invention has devoted himself based on his many years of practical experiences to the development of an adjustable dumbbell.

SUMMARY OF THE INVENTION

The primary object of the present invention is to provide an adjustable weight training device, which is adjustable in weight with a single structure for the demand of the user.

Another object of the present invention is to provide an adjustable weight training device, which is adjusted in a rotation way.

In order to achieve the aforesaid objects, the adjustable weight training device of the present invention comprises a handle having at two sides. Each side of the handle is provided with a selector unit, an adjustment unit and a plurality of weight discs. The adjustment unit is operated to change the connection of the selector unit and the plurality of weight discs so as to change the weight of the weight training device.

Preferably, the handle has a pair of extension portions at the two sides thereof. Each of the extension portions is provided with the selector unit, the adjustment unit and the plurality of weight discs.

Preferably, the selector unit is fixed on the extension portion. The bottom of the selector unit is used to connect the plurality of weight discs from bottom to top.

Preferably, the weight discs are straightly placed under the selector unit from outside to inside. Each of the weight discs has a U-like shape and an opening at an upper end thereof. The opening is adapted to connect with the selector unit. Each of the weight discs has an engaging portion thereon and a positioning notch at a lower end thereof.

Preferably, the selector unit has a plurality of movable engaging members corresponding to the engaging portions of the weight discs.

Preferably, each of the engaging members is provided with an elastic member to provide an elastic force to the relative engaging member.

Preferably, the adjustment unit is disposed at the outer side of the selector unit. The adjustment unit comprises a coupling member and an outer elastic member which are connected to the central through hole of the selector unit.

Preferably, the adjustment unit further has a plurality of protrusions which protrude from an inner side of the adjustment unit and are located at different positions with respect to the center of the adjustment unit.

Preferably, the adjustment unit has an outer engaging portion at an outer periphery thereof and the selector unit further has an inner engaging portion at one side thereof. When the adjustment unit is pulled out for rotation, the outer engaging portion will disengage from the inner engaging portion. The outer elastic member can facilitate homing of the adjustment unit after adjustment, so that the adjustment unit is in a locked state by engagement of the outer engaging portion and the inner engaging portion.

Preferably, the protrusions of the adjustment unit can be arranged at different angles for variations of weight. For example, the adjustment unit can select one weight disc, two weight discs or three weight discs.

The adjustment unit selects the weight disc according to the protrusion on the inner side of the adjustment unit to engage with the relative engaging member.

Preferably, the weight training device further comprises a base. The base has a receiving troughs corresponding in number to the weight discs. A positioning block is provided in each of the receiving troughs. The positioning block is located corresponding to the positioning notch of the relative weight disc.

DETAILED DESCRIPTION OF THE PREFERRED EMBODIMENTS

Embodiments of the present invention will now be described, by way of example only, with reference to the accompanying drawings.

Figure 1:
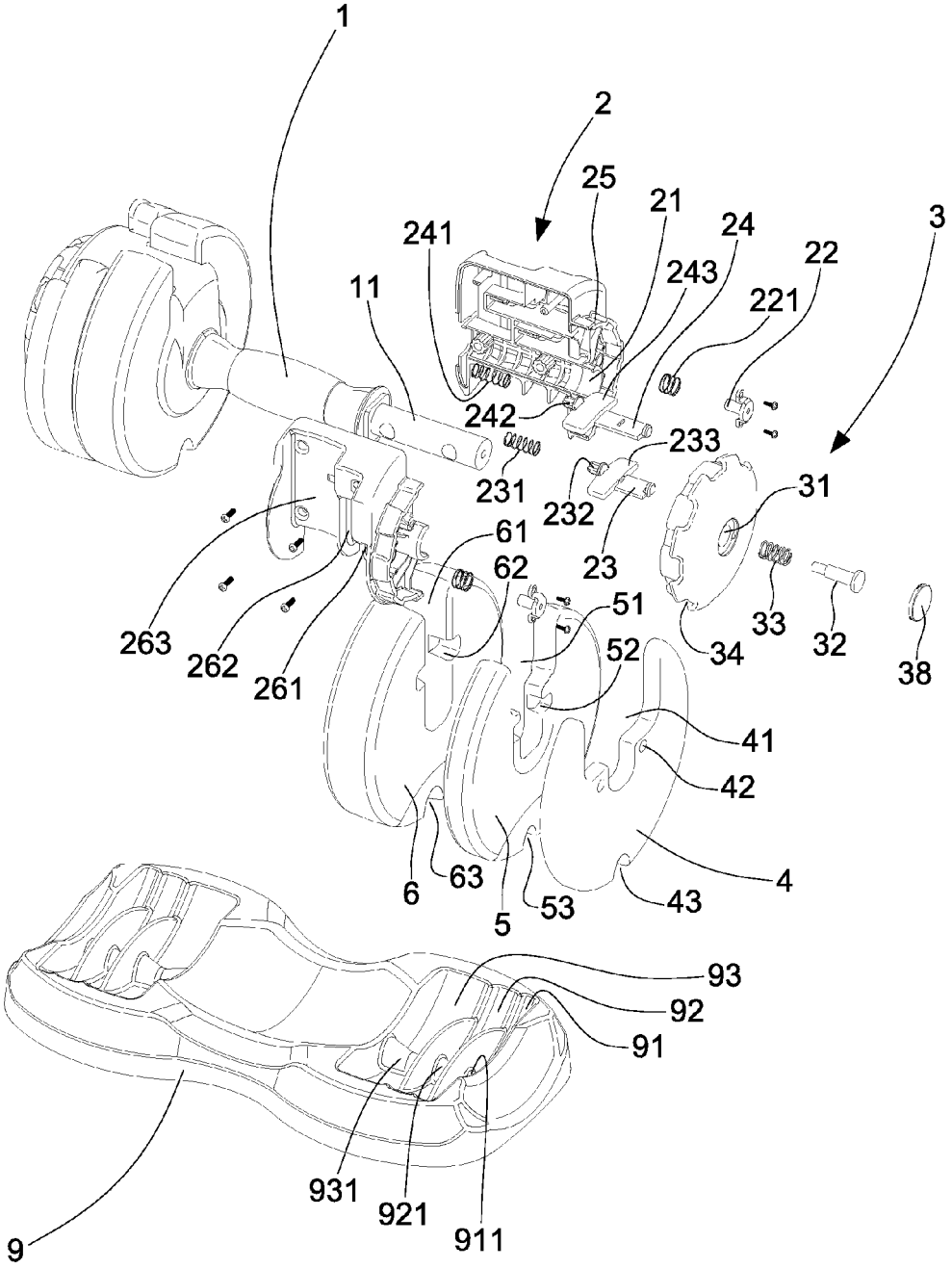
FIG. 1 is a perspective view of the present invention.
Figure 2:
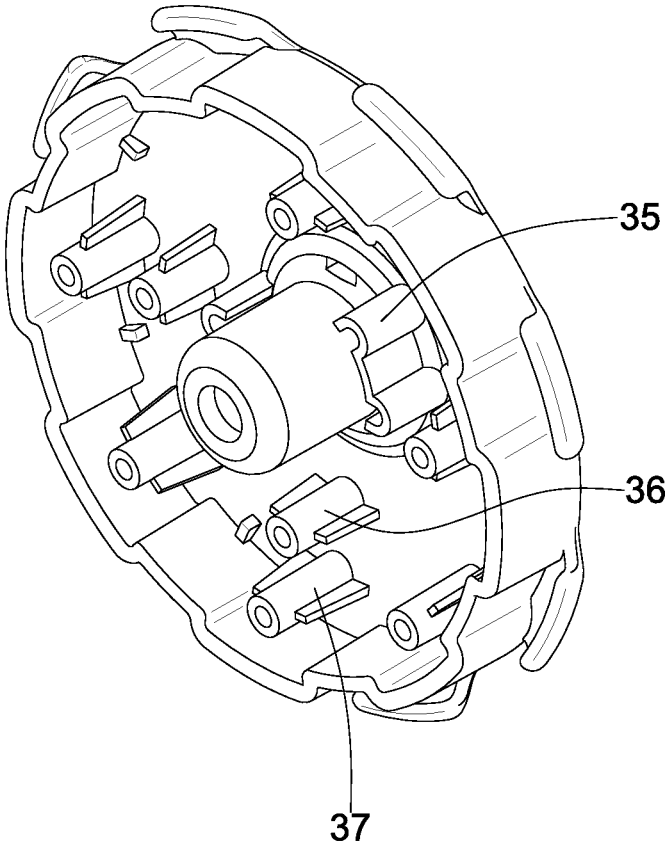
FIG. 2 is a perspective view of the adjustment unit of the present invention.

As shown in FIG. 1 and FIG. 2, the adjustable weight training device according to a preferred embodiment of the present invention comprises a handle 1 having a pair of extension portions 11 at two sides thereof. Each side of the handle 1 is provided with a selector unit 2, an adjustment unit 3 and a plurality of weight discs 4, 5, 6.

The selector unit 2 is fixed on the extension portion 11 of the handle 1. The selector unit 2 has a central through hole 21. A first engaging member 22 is provided at one side of the central through hole 21. A first elastic member 221 is provided at an inner side of the first engaging member 22. The inner side of the first engaging member 22 is inserted in the selector unit 2 and can be extended out of the selector unit 2. The selector unit 2 further comprises a second engaging member 23. The second engaging member 23 is located above the central through hole 21. A second elastic member 231 is provided at an inner side of the second engaging member 23. The inner side of the second engaging member 23 is inserted in the selector unit 2 and can be extended out of the selector unit 2. The second engaging member 23 further comprises a second positioning sleeve 232 and a second engaging plate 233. The selector unit 2 further comprises a third engaging member 24. The third engaging member 24 is located above the second engaging member 23. A third elastic member 241 is provided at an inner side of the third engaging member 24. The inner side of the third engaging member 24 is inserted in the selector unit 2 and can be extended out of the selector unit 2. The third engaging member 24 further comprises a third positioning sleeve 242 and a third engaging plate 243. The first engaging member 22, the second engaging member 23 and the third engaging member 24 are located at different positions of the selector unit 2 with respect to the central through hole 21. The first engaging member 22 is located close to the central through 21. The third engaging member 24 is located far from the central through 21. The second engaging member 23 is located between the first engaging member 22 and the third engaging member 24. The first elastic member 221, the second elastic member 231 and the third elastic member 241 provide an elastic force to the first engaging member 22, the second engaging member 23 and the third engaging member 24, respectively. The selector unit 2 further has an inner engaging portion 25 at one side thereof. Besides, the selector unit 2 further has a first accommodating through 261, a second accommodating through 262 and a third accommodating through 263 at a bottom thereof.

The adjustment unit 3 has a central hole 31, a coupling member 32 and an outer elastic member 33. The coupling member 32 and the outer elastic member 33 are connected to the central hole 31 and then coupled to the central through hole 21 of the selector unit 2. The adjustment unit 3 has an outer engaging portion 34 at an outer periphery thereof. The outer engaging portion 34 is located corresponding to the inner engaging portion 25. The adjustment unit 3 further has at least one first protrusion 35, at lest one second protrusion 36 and at least one third protrusion 37 which protrude from an inner side of the adjustment unit 3 and are located at different positions with respect to the center of the adjustment unit 3.

The plurality of weight discs includes a first weight disc 4, a second weight disc 5 and a third weight disc 6 which don't have the same weight. The first weight disc 4 has a U-like shape. The first weight disc 4 has a first opening 41 at an upper end thereof. The first opening 41 is adapted to connect with the selector unit 2. The first weight disc 4 has a first engaging portion 42 thereon. The first weight disc 4 has a first positioning notch 43 at a lower end thereof. The second weight disc 5 has a U-like shape. The second weight disc 5 has a second opening 51 at an upper end thereof. The second opening 51 is adapted to connect with the selector unit 2. The second weight disc 5 has a second engaging portion 52 thereon. The second weight disc 5 has a second positioning notch 53 at a lower end thereof. The third weight disc 6 has a U-like shape. The third weight disc 6 has a third opening 61 at an upper end thereof. The third opening 61 is adapted to connect with the selector unit 2. The third weight disc 6 has a third engaging portion 62 thereon. The third weight disc 6 has a third positioning notch 63 at a lower end thereof. The first engaging portion 42, the second engaging portion 52 and the third engaging portion 62 are not coaxial. The first weight disc 4, the second weight disc 5 and the third weight disc 6 are connected to the selector unit 2 from outside to inside in sequence.

The present invention further comprises a base 9. The base 9 has a first receiving trough 91, a second receiving trough 92 and a third receiving trough 93. A first positioning block 911, a second positioning block 921 and a third positioning block 931 are respectively provided in the first receiving trough 91, the second receiving trough 92 and the third receiving trough 93. The first positioning block 911, the second positioning block 921 and the third positioning block 931 are located corresponding to the first positioning notch 43, the second positioning notch 53 and the third positioning notch 63, respectively.

Figure 3:
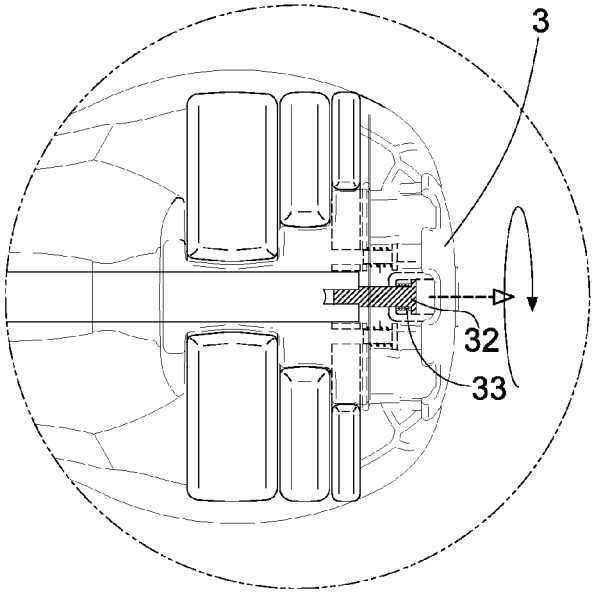
FIG. 3 is a schematic view to show that the adjustment unit is pulled outward and rotated.
Figure 4:
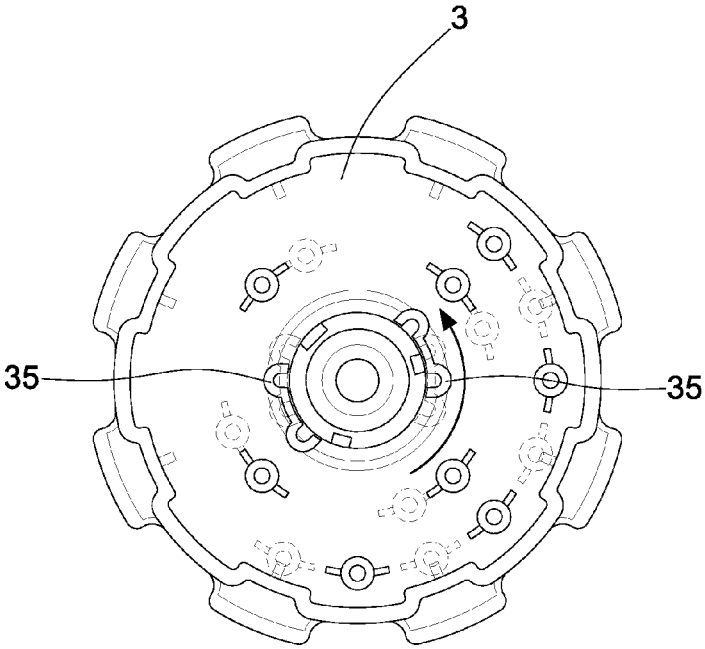
FIG. 4 is a schematic view to show rotation of the adjustment unit.
Figure 5:
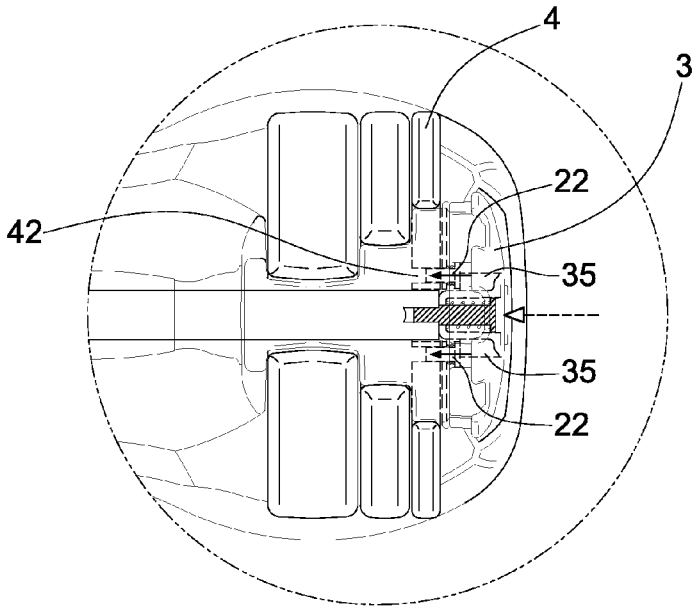
FIG. 5 is a schematic view to show that the homing of the adjustment unit drives the first engaging member to engage with the first weight disc.
Figure 6:
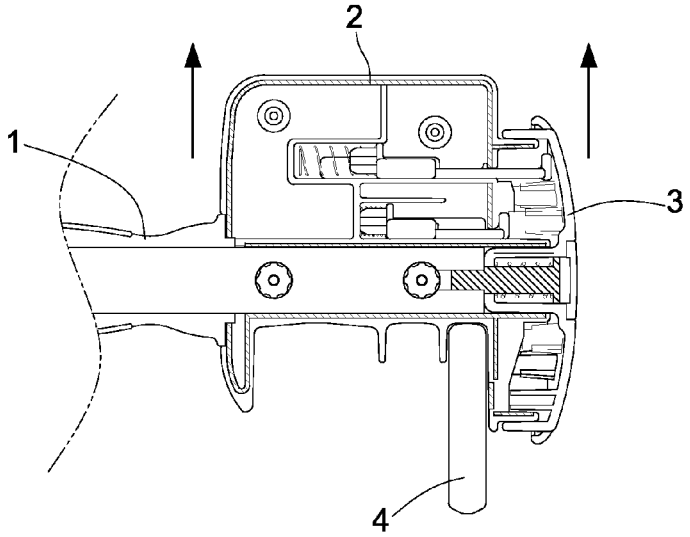
FIG. 6 is a schematic view to show that the first weight disc is selected for use.

Accordingly, the adjustable weight training device of the present invention comprises the handle 1, two selector units 2 and two adjustment units 3 to be an integral configuration. When in use, the first weight disc 4, the second weight disc 5 and the third weight disc 6 are placed in the first receiving trough 91, the second receiving trough 92 and the third receiving 93, and then the handle 1, the two selector units 2 and the two adjustment units 3 are placed above the first weight disc 4, the second weight disc 5 and the third weight disc 6. Referring to FIG. 1, FIG. 2 and FIG. 3, the adjustment unit 3 is slightly pulled out for the outer engaging portion 34 to disengage from the inner engaging portion 25, and then the adjustment unit 3 is rotated to change the positions of the first protrusion 35, the second protrusion 36 and the third protrusion 37. When the first protrusion 35 is just located at the outer end of the first engaging member 22, the pulling of the adjustment unit 3 is stopped and the outer elastic member 33 pushes the adjustment unit 3 inward for homing, as shown in FIG. 5. The first engaging member 22 compresses the first elastic member 221 to move the first engaging member 22 inward. The inner end of the first engaging member 22 is extended out of the selector unit 2 and inserted in the first engaging portion 42, such that the first weight disc 4 is connected to the selector unit 2. As shown in FIG. 6, the first weight disc 4 is hanged on the handle 1.

Figure 7:
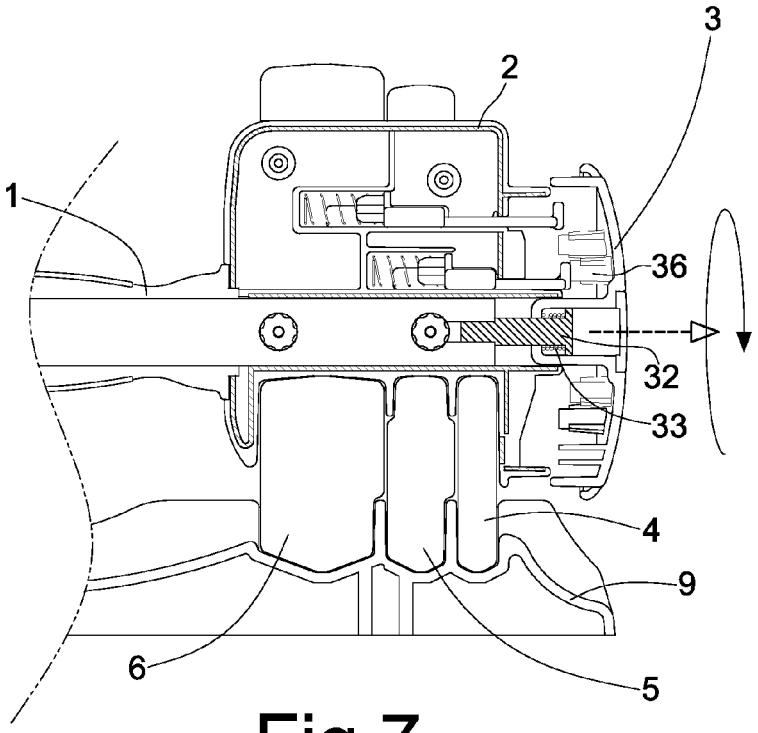
FIG. 7 is a schematic view to show that the adjustment unit is pulled outward and rotated.
Figure 8:
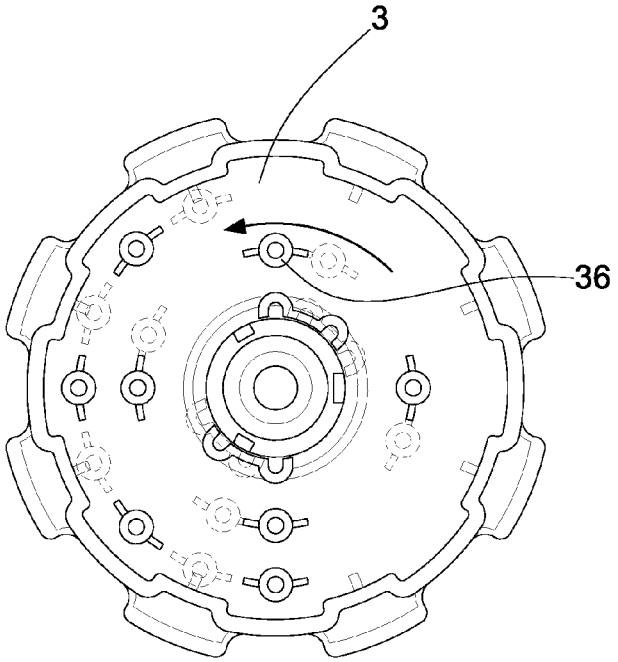
FIG. 8 is a schematic view to show rotation of the adjustment unit.
Figure 9:
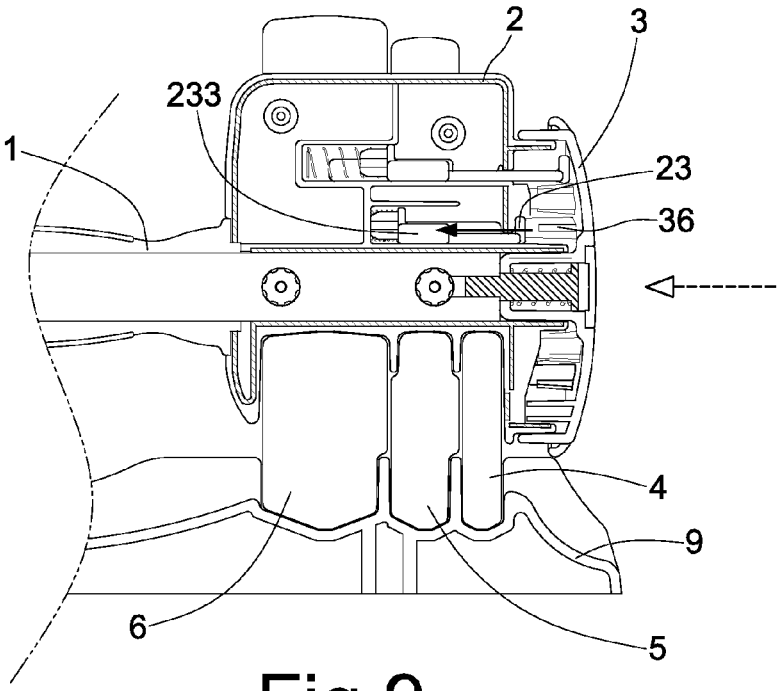
FIG. 9 is a schematic view to show that the homing of the adjustment unit drives the second engaging member to engage with the second weight disc.
Figure 10:
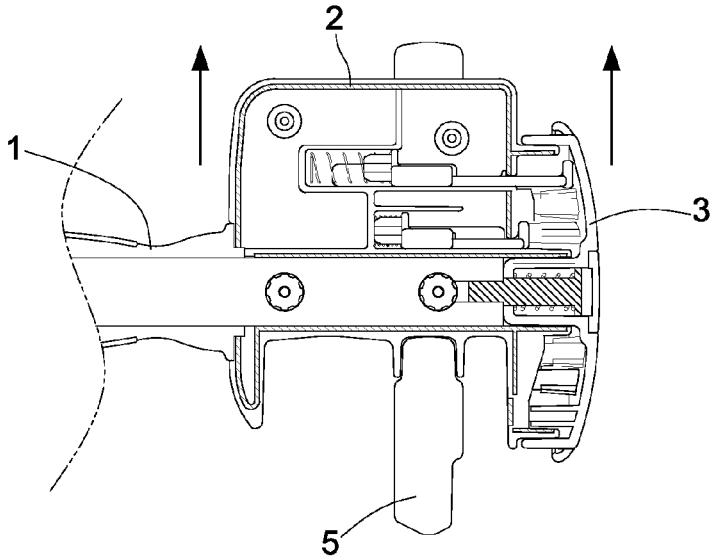
FIG. 10 is a schematic view to show that the second weight disc is selected for use.
Figure 11:
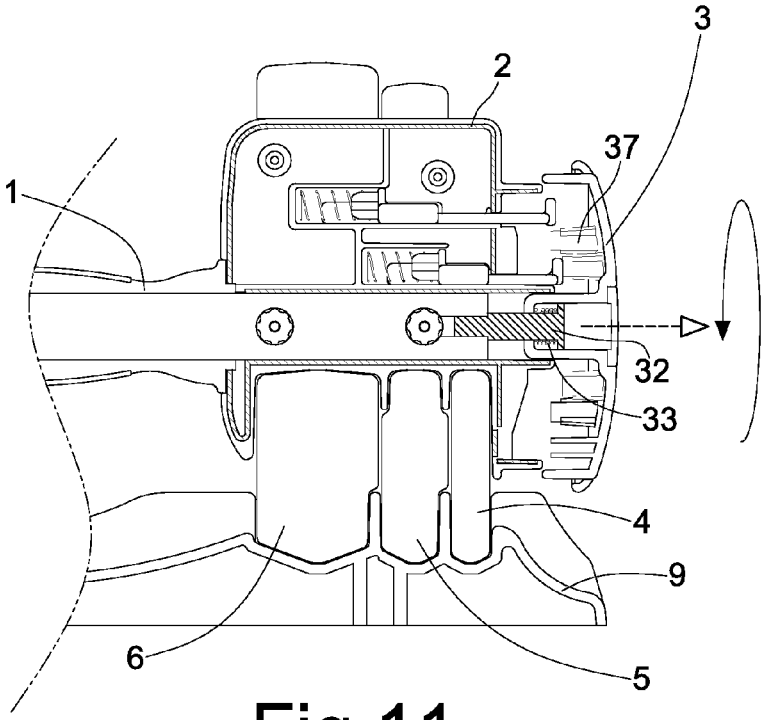
FIG. 11 is a schematic view to show that the adjustment unit is pulled outward and rotated.

When the user wants to select the second weight disc 5, the adjustment unit 3 is slightly pulled out for the outer engaging portion 34 to disengage from the inner engaging portion 25, referring to FIG. 1, FIG. 7 and FIG. 8, and then the adjustment unit 3 is rotated to change the positions of the first protrusion 35, the second protrusion 36 and the third protrusion 37. When the second protrusion 36 is just located at the outer end of the second engaging member 23, the pulling of the adjustment unit 3 is stopped and the outer elastic member 33 pushes the adjustment unit 3 inward for homing, as shown in FIG. 9. The second engaging member 23 compresses the second elastic member 231 to move the second engaging member 23 inward. The inner end of the second engaging member 23 is extended out of the selector unit 2 and inserted in the second engaging portion 52, such that the second weight disc 5 is connected to the selector unit 2. As shown in FIG. 10, the second weight disc 5 is hanged on the handle 1.

Figure 12:
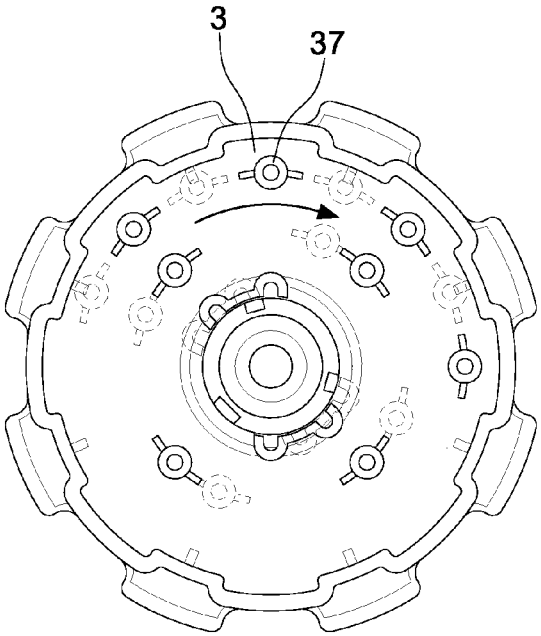
FIG. 12 is a schematic view to show rotation of the adjustment unit.
Figure 13:
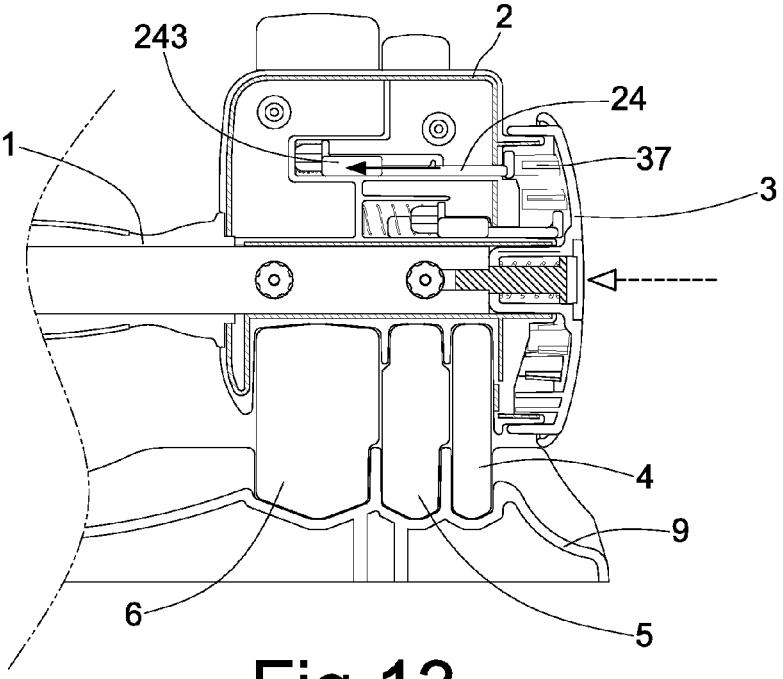
FIG. 13 is a schematic view to show that the homing of the adjustment unit drives the third engaging member to engage with the third weight disc.
Figure 14:
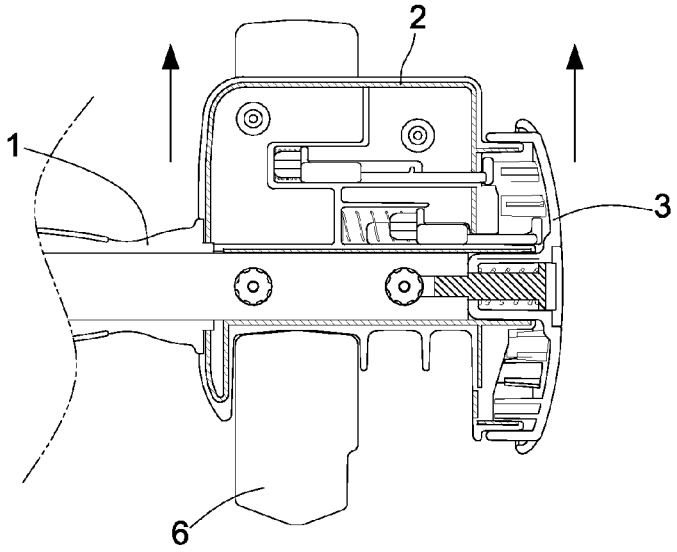
FIG. 14 is a schematic view to show that the third weight disc is selected for use.

When the user wants to select the third weight disc 6, the adjustment unit 3 is slightly pulled out for the outer engaging portion 34 to disengage from the inner engaging portion 25, referring to FIG. 1, FIG. 10 and FIG. 12, and then the adjustment unit 3 is rotated to change the positions of the first protrusion 35, the second protrusion 36 and the third protrusion 37. When the third protrusion 37 is just located at the outer end of the third engaging member 24, the pulling of the adjustment unit 3 is stopped and the outer elastic member 33 pushes the adjustment unit 3 inward for homing, as shown in FIG. 13. The third engaging member 24 compresses the third elastic member 241 to move the third engaging member 24 inward. The inner end of the third engaging member 24 is extended out of the selector unit 2 and inserted in the third engaging portion 62, such that the third weight disc 6 is connected to the selector unit 2. As shown in FIG. 14, the third weight disc 6 is hanged on the handle 1.

The first protrusion 35, the second protrusion 36 and the third protrusion 37 can be disposed at different rotation angles, such as 45 degrees, so that the first protrusion 35, the second protrusion 36 and the third protrusion 37 can have many arrangements. When the adjustment unit 3 is rotated to a specific position, the corresponding relationships are as follows:

1. Only one of the first protrusion 35, the second protrusion 36 and the third protrusion 37 gets contact with one of the first engaging member 22, the second engaging member 23 and the third engaging member 24, and only one of the first weight disc 4, the second weight disc 5 and the third weight disc 6 is selected. There are three variations.
2. Two of the first protrusion 35, the second protrusion 36 and the third protrusion 37 get contact with two of the first engaging member 22, the second engaging member 23 and the third engaging member 24, and two of the first weight disc 4, the second weight disc 5 and the third weight disc 6 are selected. There are three variations.
3. All of the first protrusion 35, the second protrusion 36 and the third protrusion 37 get contact with all of the first engaging member 22, the second engaging member 23 and the third engaging member 24, and all of the first weight disc 4, the second weight disc 5 and the third weight disc 6 are selected.

Therefore, the present invention has seven variations to select the weight discs.

There are three weight discs in this embodiment of the present invention. The number of the weight discs can be increased. Similarly, the numbers of the engaging members, the protrusions and the engaging portions are relatively increased.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An adjustable weight training device, comprising a handle, the handle having a pair of extension portions at two sides thereof, each of the extension portions of the handle being provided with a selector unit, an adjustment unit and a plurality of weight discs;

the selector unit being fixed on the relative extension portion of the handle, the selector unit having a plurality of movable engaging members;

the adjustment unit being movable and disposed at an outer side of the selector unit, the adjustment unit having a plurality of protrusions on an inner side thereof, the protrusions being adapted to drive the engaging members to move;

each of the weight discs having an opening to connect with the selector unit, each of the weight discs having an engaging portion for insertion of the relative engaging member.

2. The adjustable weight training device as claimed in claim 1, wherein the selector unit has a central through hole, a first engaging member provided at one side of the central through hole, and a first elastic member provided at an inner side of the first engaging member, the inner side of the first engaging member being inserted in the selector unit and extended out of the selector unit.

3. The adjustable weight training device as claimed in claim 1, wherein the selector unit further has a second engaging member located above the central through hole and a second elastic member located at an inner side of the second engaging member, the inner side of the second engaging member being inserted in the selector unit and extended out of the selector unit.

4. The adjustable weight training device as claimed in claim 3, wherein the selector unit further has a third engaging member located above the second engaging member and a third elastic member located at an inner side of the third engaging member, the inner side of the third engaging member being inserted in the selector unit and extended out of the selector unit.

5. The adjustable weight training device as claimed in claim 4, wherein the first engaging member, the second engaging member and the third engaging member are located at different positions of the selector unit with respect to the central through hole, the first elastic member, the second elastic member and the third elastic member providing an elastic force to the first engaging member, the second engaging member and the third engaging member, respectively.

6. The adjustable weight training device as claimed in claim 5, wherein the first engaging member is located close to the central through, the third engaging member is located far from the central through, and the second engaging member is located between the first engaging member and the third engaging member.

7. The adjustable weight training device as claimed in claim 1, wherein the selector unit further has an inner engaging portion at one side thereof and the adjustment unit has an outer engaging portion at an outer periphery thereof, the outer engaging portion being located corresponding to the inner engaging portion.

8. The adjustable weight training device as claimed in claim 2, wherein the adjustment unit has a central hole, a coupling member and an outer elastic member, the coupling member and the outer elastic member being connected to the central hole and then coupled to the central through hole of the selector unit.

9. The adjustable weight training device as claimed in claim 1, wherein the adjustment unit further has at least one first protrusion, at lest one second protrusion and at least one third protrusion which protrude from an inner side of the adjustment unit and are located at different positions with respect to the center of the adjustment unit.

10. The adjustable weight training device as claimed in claim 1, wherein the weight discs includes a first weight disc, a second weight disc and a third weight disc which don't have the same weight, each of the weight discs having a U-like shape and a positioning notch at a lower end thereof, the device further comprising a base, the base having a plurality of receiving troughs and a positioning block in each of the receiving troughs, the positioning block being located corresponding to the positioning notch.

* * * * *